United States Patent [19]

Singleton et al.

[11] 4,107,765

[45] Aug. 15, 1978

[54] SELF-ILLUMINATING HAND TOOL

[75] Inventors: Max C. Singleton, Novato, Calif.; Lea Frances Elgart, 100 Village Cir., Novato, Calif. 94947

[73] Assignee: Lea Frances Elgart, Novato, Calif.

[21] Appl. No.: 719,989

[22] Filed: Sep. 2, 1976

[51] Int. Cl.[2] ..... F21L 7/00

[52] U.S. Cl. ..... 362/120; 362/205

[58] Field of Search ..... 240/2 E, 6.4 R, 6.46, 240/10.66, 10.68; 145/61R; 362/119, 120, 157, 205

[56] References Cited

U.S. PATENT DOCUMENTS

| | | | |
|---|---|---|---|
| 2,175,481 | 10/1939 | Padulo | 145/61 R UX |
| 2,288,093 | 6/1942 | Kaffenberger et al. | 240/6.46 |
| 2,442,893 | 6/1948 | Henderson | 240/6.46 |
| 2,461,118 | 2/1949 | Lippincott | 362/205 |
| 2,736,792 | 2/1956 | Freeland | 240/6.46 |

*Primary Examiner*—Michael L. Gellner
*Attorney, Agent, or Firm*—Melvin R. Stidham

[57] ABSTRACT

A hand held tool has a handle of generally rectangular cross section and a bulbous end portion. A shank is embedded in the handle and extends from the end opposite the bulbous portion to terminate in a work engaging tool such as a screwdriver blade. A self-focusing light bulb is carried in a relieved portion of one side of the handle and is electrically connected to a battery also carried in the relieved portion. A retaining member providing a metal strip removably mounts in place on the handle to retain the battery and light bulb in the relieved portion and to provide a smooth closure therefore. A tang on the metal strip engages one end of the battery, and the other end of the strip extends forwardly in slightly spaced relation to the base of the light bulb. An annular member encircles the end of the handle adjacent to the shank and has a plurality of spaced detents formed around its inner periphery, these detents being adapted to hold the annular member in place and to engage and depress the end of the metal strip into electrical contact with the base of the light bulb when the annular member is rotated. An inwardly extending flange is provided on the annular member to enclose the light bulb and is either transparent or is formed with a light transmitting opening which becomes aligned with the beam of light emanating from the light bulb when the annular member is rotated to its "power on" position in which the electrical circuit is completed.

12 Claims, 10 Drawing Figures

SELF-ILLUMINATING HAND TOOL

SUMMARY OF THE INVENTION

This invention relates to self-illuminating hand tools, and more particularly to tools adapted for working under adverse lighting conditions.

A number of previous attempts have been made to provide a tool, such as a screwdriver, containing its own source of illumination. For example, see the following U.S. Pat. Nos.: Stowell, 2,158,970; White et al., 2,240,596; Henderson, 2,442,893; Henderson, 2,673,284; Markett, 2,773,974; Wood, 2,813,968; and Caho, 3,919,541. All of the prior devices are either unhandy, make replacement of batteries and light bulbs difficult, do not afford adequate protection for the light bulb, interfere with use by the operator, or are not sturdy enough to withstand hard knocks, dropping and the like to which screwdrivers are often subjected. The self-illuminating hand tool of the present invention, on the other hand, is extremely sturdy, the batteries and light bulbs are concealed and protected at all times, the switch is easy and simple to operate, and none of the illuminating mechanism interferes in any way with the normal use of the hand tool.

Accordingly, it is the principal object of the present invention to provide a self-illuminating hand tool which is simple and sturdy in design utilizing a minimum number of rigid and long-wearing parts.

Another object of the present invention is to provide a self-illuminating hand tool of the character described in which both the batteries and light bulbs can be easily and quickly replaced without requiring special tools or parts.

A further object of the invention is to provide a tool of the character described and which can easily and quickly be adapted to accommodate either elongated, cylindrical "pen"-type batteries or disk-type batteries such as are often found in hearing aids and electric watches.

A still further object of the invention is to provide a tool of the character set forth in which the work-engaging portions are interchangeable.

Other objects and features of advantage will become apparent from the following specification and from the claims.

Figure 1:
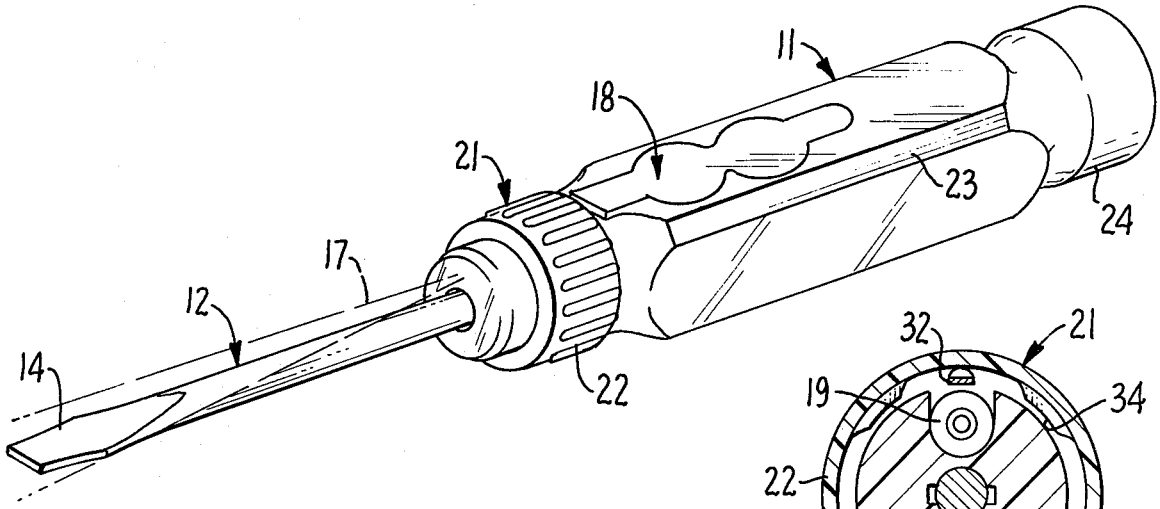
FIG. 1 is a perspective view of a preferred form of a self-illuminating hand tool constructed in accordance with the present invention.

While only the preferred forms of the invention have been shown in the drawings, it will be apparent that changes and modifications could be made thereto within the ambit of the invention as defined in the claims.

DESCRIPTION OF THE PREFERRED EMBODIMENTS

Referring to the drawings in detail, it will be seen that the self-illuminating hand tool of the present invention includes an elongated handle 11, a shank 12 having an end 13 rigidly mounted in the handle and a work-engaging structure 14 at its distal end, a prefocussed light bulb 16 mounted in handle 11 in position to direct a beam of light 17 onto work engaged by the tool structure 14, power supply means 18 in handle 11 for supporting an electric battery 19 and effecting electrical connection of same with light bulb 17, and switch means 21 formed for making and breaking the electrical connection and including an annular member 22 rotatably mounted on the end of handle 11 encircling shank 12 for manual engagement and rotary displacement between a "power on" position making said electrial connection and a "power off" position breaking said electrical connection.

The shape of handle 11 at the central portion is preferably of generally square cross section, having slightly rounded corners 23 for smoothness so as to avoid discomfort to the hand of the user. The generally square cross-sectional shape provides a better grip for the hand and increased torque at the work-engaging structure 14. The rear end 24 is rounded to provide a comfortable spin surface for fast turning once the work, such as a screw (not shown), is loosened. The forward end of the handle adjacent shank 12 is reduced somewhat in size to provide for thumb comfort.

It should be appreciated that the self-illuminating hand tool of the present invention is adapted for use with a number of different work-engaging structures 14. As here shown, shank 12 is in the form of an axially extending rod terminating in a conventional screwdriver blade. Shank 12 may also terminate in other types of screwdriving implements, such as a screwdriver head for Phillips head screws. Sockets, wrenches, chisels, soldering tips, and the like can be provided alternatively to the screwdriver blade depicted. Also, the shanks may be demountable and replaceable in handle 11, such as by using a conventional structure 26 of the type illustrated in FIG. 1 of the drawings.

As a feature of the present invention, the self-illuminating hand tool of the present invention is adapted for usual types of work in well-lighted areas not requiring the self-illuminating feature. To this end, all of the mechanism of the self-illuminating feature is concealed within the handle 11, with the exception of the annular member 22 which serves to actuate the switch means 21. Annular member 22 encircles the forward end of the handle, away from the portion normally gripped by the user, and does not protrude unduly from the handle so as to interfere with conventional use of the tool. In order to accomplish this result, the handle 11 is formed with a relieved portion or recess 27 accommodating the power supply means 18 and light bulb 16, the power supply means 18 being formed to provide a smooth continuation of the configuration of handle 11.

Power supply means 18 includes a removable metal strip 28 extending the length of the recess 27 and terminating in a first end 29 electrically contacting a terminal 31 of battery 19. Metal strip 28 also provides a resiliently displaceable second end 32 in spaced relation to the base 33 in such manner that deflection of end 32 into contact with light bulb base 33 will effect electrical connection of the battery terminal 31 to the terminal of the light bulb provided by base 33.

In accordance with the present invention, rotation of annular member 22 serves to deflect end 29 of metal strip 28 into contact with light bulb base 33 in a selective manner. This is accomplished by a plurality of circumferentially spaced raised portions or detents 34 on its inner periphery. Detents 34 provide a camming action against end 32 of metal strip 28 for selectively urging the latter into electrical contact with the base terminal 33 of the light bulb 16.

As shown in the form of the invention illustrated in FIGS. 1 through 5 of the drawings, the end portion 36, and preferably the entire annular member 22 is formed of clear plastic so that annular member 22 will cooperate with handle 11 to enclose and protect light bulb 16 at all times, and will transmit the beam of light 17 when the switch means 21 is in its "power on" position with one of the detents 34 urging end 32 of metal strip 28 into electrical contact with base 33 of light bulb 16.

Figure 3:
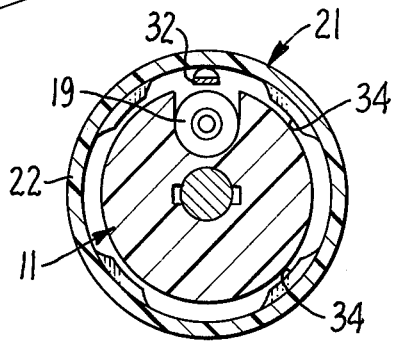
FIG. 3 is a cross-sectional view taken substantially on the plane of line 3—3 of FIG. 2 and showing a rotary switch mechanism.
Figure 2:
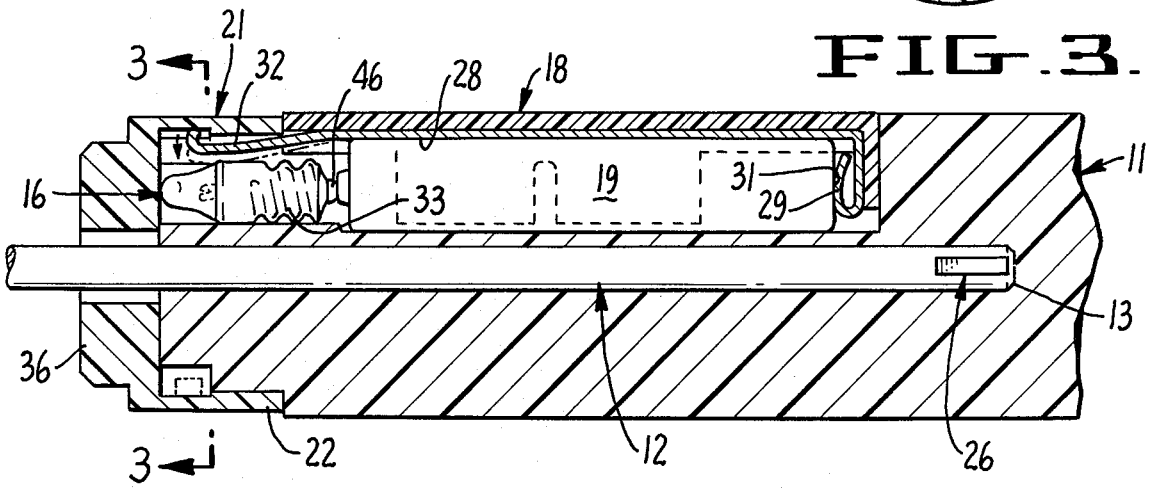
FIG. 2 is a longitudinal cross-sectional view of an enlarged scale of the handle of the tool of FIG. 1.
Figure 4:
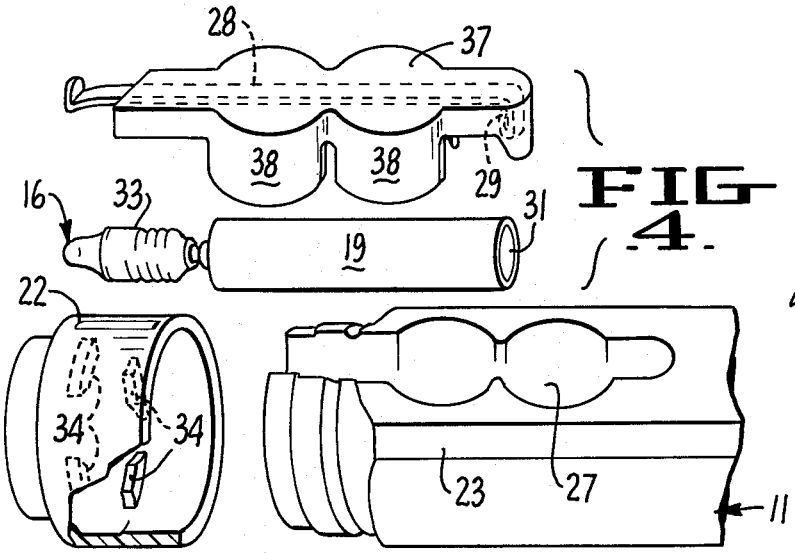
FIG. 4 is a perspective exploded view of the handle of FIG. 2.
Figure 5:
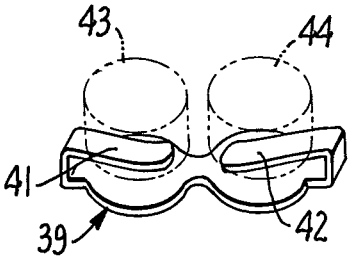
FIG. 5 is an exploded perspective view of the parts used to adapt the handle of FIG. 2 for use with disk-type batteries.

In the form of the invention illustrated in FIGS. 1 through 5, the power supply means includes the metal strip 28 carried by a closure member having a configuration closely conforming to the recess 27 in handle 11. Closure member 37 is formed for removable mounting in recess 27 for releasably retaining the battery 19 and light bulb 16 within handle 11 so that no part thereof protrudes or interferes with normal use of the tool. As here shown, the recess 27 is elongated and is formed for interchangeably receiving both elongated cylindrical pen-type and disk-shaped batteries. A pen-type battery is illustrated in FIGS. 2, 3, and 4 of the drawings, while disk-shaped batteries are illustrated in dotted lines in FIG. 5 of the drawings.

Closure member 37 has inwardly extending curved wall portions 38 formed to receive and support one or more disk batteries, and recess 27 has curved walls to accommodate the wall portions 38. When disk batteries are to be mounted in the unit, an adaptor 39 is provided in the form of a second metal strip mountable at the bottom of recess 27 and having upwardly and inwardly turned ends 41 and 42 which resiliently press against the bottom surfaces of the disk batteries 43 and 44, respectively, when the latter are pressed down into recess 27 by closure member 37. End 41 is extended far enough to engage the central terminal 46 so the circuit will be completed when end 32 of strip 28 is pressed down against light bulb base terminal 33.

In the form of the invention illustrated in FIGS. 6 through 10 of the drawings, parts similar to those in FIGS. 1 through 5 are provided with like reference numerals. As here shown, a metal strip 28A forms the closure for the recess 27A. As may best be seen in FIGS. 8 and 9 of the drawings, recess 27A is formed with grooved portions 47 adjacent to the exterior of handle 11, and the metal strip 28A is formed with lugs 48 removably engageable in the grooved portions 47 so that metal strip 28A may be readily snapped into place as a closure for the recess 27A and easily snapped out for changing the battery and light bulb.

Figure 6:
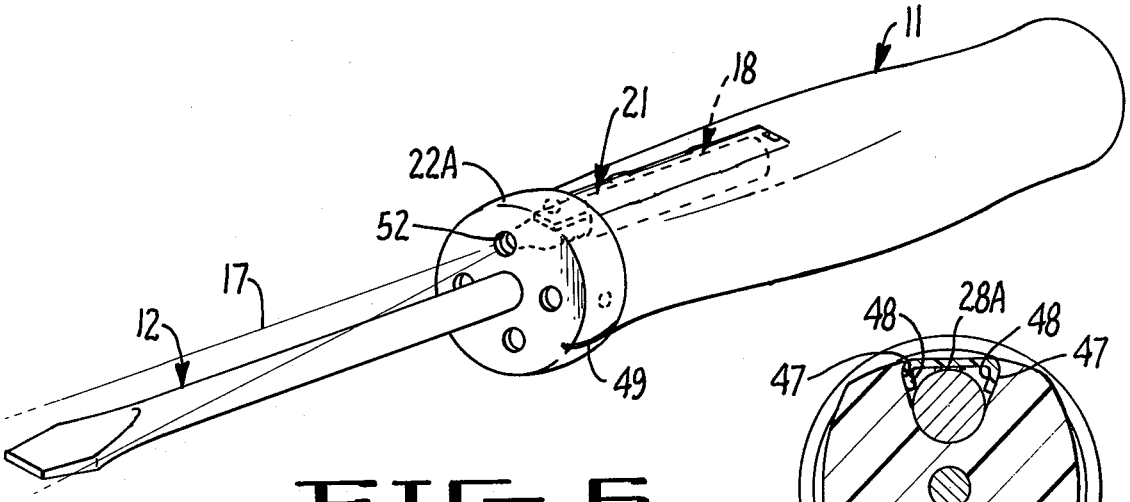
FIG. 6 is a perspective view of a modified form of the self-illuminating hand tool of the present invention.
Figure 8:
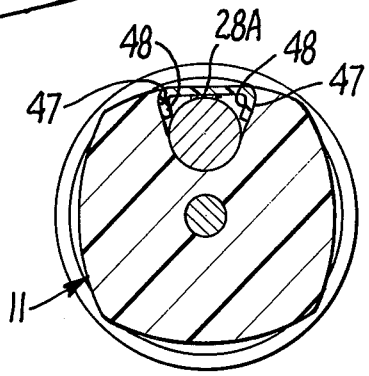
FIG. 8 is a cross-sectional view taken substantially on the plane of line 8—8 of FIG. 7.
Figure 7:
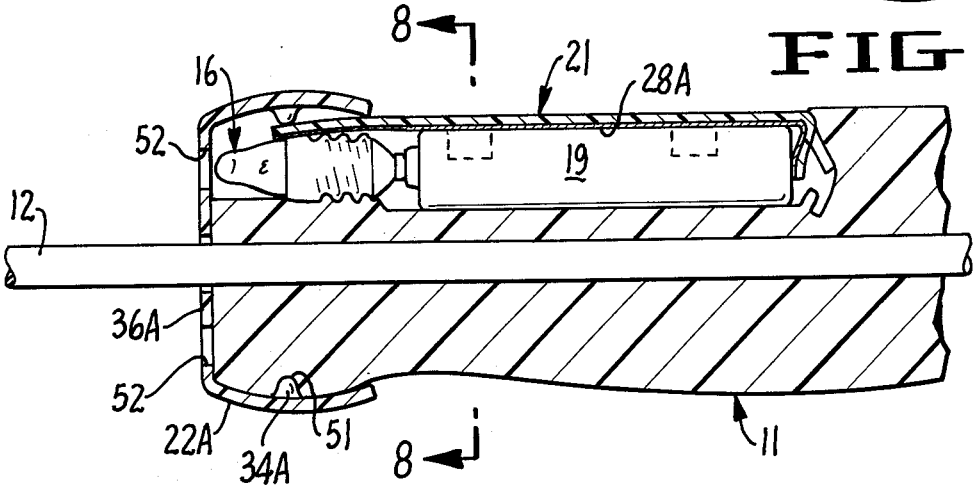
FIG. 7 is a fragmentary longitudinal cross-sectional view on an enlarged scale of a portion of the handle of FIG. 6.
Figure 9:
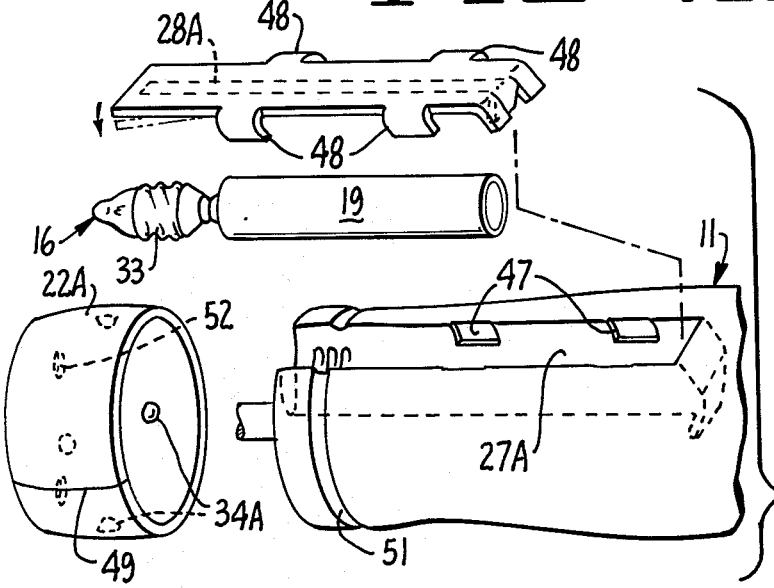
FIG. 9 is an exploded perspective view of the portion of the handle of FIG. 7.

As shown in FIGS. 6, 7, and 9 of the drawings, the annular member 22A may be of metal or plastic and is of generally cup shape. The wall of the cup is split, as illustrated at 49, so that detents 34A may be snapped into a circumferential groove 51 formed in the end of handle 11 through which shank 12 passes for rotatably retaining member 22A in place. Where the member 22A is made of metal or other opaque material, openings 52 are provided through wall 36A for passage of the light beam 17 when the annular member 22A is in "power on" position. If desired, the openings 52 may be filled with a suitable transparent plastic material.

Figure 10:
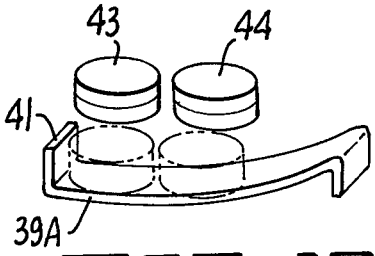
FIG. 10 is an exploded perspective view of an adaptor to accommodate the mechanism of FIG. 7 for use with disk-shaped batteries.

As shown in FIG. 10, an adaptor 39A is provided for using disk batteries 43 and 44. Member 39A is positioned at the bottom of recess 29A and end 41A contacts the center terminal 46 of light bulb 16, thus completely the circuit path.

From the foregoing, it will be apparent that we have provided a novel and valuable self-illuminating hand tool which can be used on every job and not just when the mechanic needs light to illuminate the work area. The present tool is adapted for regular use, all day long and on any kind of job. When the user needs light on the work area, he can have light instantly without using his other hand or changing tools.

What is claimed is:

1. A self-illuminating hand tool, comprising an elongated handle;

a shank extending from said handle with a work engaging tool structure at its distal end;

a prefocussed light bulb mounted in said handle in fixed position to direct a beam of light emitted therefrom onto work engaged by said tool structure;

power supply means in said handle for supporting an electric power source and effecting electrical connection of same with said bulb end;

switch means formed for making and breaking said electrical connection and including a metal strip having an end portion thereof extending alongside and normally spaced from the base of said light bulb, and an annular member rotatably mounted on the end of said handle encircling said shank for manual engagement and rotary displacement between a power on position making said electrical connection and a power off position breaking said electrical connection;

said annular member being formed for engaging and urging said end portion against said light bulb base upon rotation to said power on position;

said handle being formed with a recess in a side thereof accommodating said power supply means and said light bulb, and said power supply means including a cover for said recess to provide a smooth continuation of the configuration of said handle.

2. A hand tool as described in claim 1 and wherein said handle is of generally square cross-sectional configuration in its medial position.

3. A hand tool as described in claim 2 and wherein said handle is formed with a bulbous knob at its anterior end opposite to said shank.

4. A hand tool as described in claim 1 and wherein said work engaging tool structure is a screwdriver blade.

5. A hand tool as described in claim 1 and wherein said light bulb is encircled by said annular member, and said annular member is formed with a light transmitting portion for passing said beam of light when said annular member is in said power on position, said annular member being formed to cover and protect said light bulb when said annular member is in said power off position.

6. A hand tool as described in claim 1 and wherein said annular ring is formed with a plurality of circumferentially spaced detents on its inner periphery providing camming action against said end portion of said metal strip for selectively urging the latter into electrical contact with a base terminal of said light bulb, the other base terminal of said light bulb being held in electrical contact with the other terminal of said power source within said relieved position of said handle.

7. A hand tool as described in claim 1 and wherein said metal strip is removable and replaceable when in place extends the length of said recess, terminating in a first end opposite said end portion electrically contacting a terminal of said power source.

8. A hand tool as described in claim 7 and wherein said recess is formed with grooved portions adjacent to the exterior of said handle, and said metal strip is formed with lugs removably engageable in said grooved portions whereby said metal strip may be readily snapped into place as a closure for said recess and easily snapped out for changing said power source and light bulb.

9. A hand tool as described in claim 7 and wherein said metal strip is carried by a closure member having a configuration closely conforming to said recess of said handle and formed for removable mounting in the latter for releasably retaining said power source and light bulb in said relieved portion.

10. A hand tool as described in claim 9 and wherein said recess is elongated for interchangeably receiving pen type and disk batteries.

11. A hand tool as described in claim 10 and wherein said closure member has inwardly extending curved wall portions formed to receive and support a disk battery, and a second metal strip in said recess in position for electrically contacting the terminal of said battery and the base terminal of said light bulb not contacted by said first named metal strip.

12. A self-illuminating hand tool comprising:

an elongated handle of polygonal cross-section for a work-engaging tool;

a recess in one side of said handle adjacent one end thereof;

a prefocussed light bulb mounted in said recess in fixed position to direct a beam of light emitted through said one end onto work engaged by said tool;

an electric power source in said recess with one terminal thereof engaging one base terminal of said light bulb;

a metal strip extending along said recess with one end thereof engaging the other terminal of said power source and the other end thereof extending adjacent to, but normally spaced from, the other base terminal of said light bulb;

an annular member rotatably mounted on said one end of the handle around said other end of the metal strip between power on and off positions; and means on said annular member for engaging and urging said other end of the metal against said light bulb when in said power on position.

* * * * *